US005889503A

United States Patent [19]

Kikuchi et al.

[11] Patent Number: 5,889,503

[45] Date of Patent: Mar. 30, 1999

[54] SIGNAL PROCESSING CIRCUIT AND LIQUID CRYSTAL DISPLAY APPARATUS USING THE SAME CIRCUIT

[75] Inventors: Shin Kikuchi, Isehara; Kazuyuki Shigeta, Atsugi, both of Japan

[73] Assignee: Canon Kabushiki Kaisha, Tokyo, Japan

[21] Appl. No.: 764,300

[22] Filed: Dec. 12, 1996

[30] Foreign Application Priority Data

Jan. 31, 1996 [JP] Japan ..... 8-015675
Aug. 5, 1996 [JP] Japan ..... 8-205780

[51] Int. Cl.[6] ..... G09G 3/36

[52] U.S. Cl. ..... 345/98; 345/87; 345/100; 345/101; 345/208

[58] Field of Search ..... 345/98, 100, 96, 345/99, 94, 87, 101, 58, 95, 89, 208, 209, 210, 211; 348/790, 792, 793, 687, 688, 689

[56] References Cited

U.S. PATENT DOCUMENTS 4,686,562 8/1987 Yamanaka ..... 358/32
4,701,786 10/1987 Yamanaka ..... 358/32
4,821,087 4/1989 Honjo ..... 358/34
4,859,871 8/1989 Kobayaski et al. ..... 307/264
5,142,354 8/1992 Susuki et al. ..... 358/34
5,283,477 2/1994 Shibata ..... 307/264
5,296,929 3/1994 Morimoto ..... 358/607
5,302,860 4/1994 Fischer et al. ..... 307/264

*Primary Examiner*—Wellington Chin
*Assistant Examiner*—Keith Ferguson
*Attorney, Agent, or Firm*—Fitzpatrick, Cella, Harper & Scinto

[57] ABSTRACT

A signal processing circuit is disclosed in which the DC level of a signal having constant signal value periods during each of non-inverting periods and inverting periods can be correctly adjusted. The circuit has first and second sample-and-hold sections which perform sample-and-hold operations on the signal value which occurs during the constant signal value periods of the non-inverting and inverting periods. An averaging section averages the sample-and-hold values of the sample-and-hold sections. A feedback section compares the output value of the averaging section with a reference value and, upon comparison, feeds back the resulting value to the signal processing section. Also disclosed is a liquid crystal display apparatus using the above-described signal processing circuit.

26 Claims, 11 Drawing Sheets

| | | | | | | | | |
|---|---|---|---|---|---|---|---|---|
| 111 | R | G | B | R | G | B | R | G |
| 112 | B | R | G | B | R | G | B | R |
| 113 | G | B | R | G | B | R | G | B |
| | R | G | B | R | G | B | R | G |
| | B | R | G | B | R | G | B | R |

SIGNAL PROCESSING CIRCUIT AND LIQUID CRYSTAL DISPLAY APPARATUS USING THE SAME CIRCUIT

BACKGROUND OF THE INVENTION

1. Field of the Invention

The present invention relates generally to a signal processing circuit and a liquid crystal display apparatus. More particularly, the invention relates to a signal processing circuit provided with signal processing means for non-inverting and inverting an input signal based on a reference potential and outputting the resulting signal. The invention also relates to a liquid crystal display apparatus using the above-described signal processing circuit.

2. Related Background Art

Hitherto, the following type of signal processing circuit shown in FIG. 11 has been known: a signal processing circuit for amplifying an input signal while switching it between non-inverting periods and inverting periods.

Referring to FIG. 11, the signal processing circuit includes an amplifier 11, a comparator 12, a low pass filter (LPF) 13, and reference voltage sources 14*a* and 14*b* (the respective reference voltages are indicated by V0 and V1, which may be equal to each other). Upon receiving an input signal (IN), the amplifier 11 compares the input signal (IN) with the reference voltage V1 of the reference voltage source 14*b* to produce a difference signal of the above two signals. It then amplifies the difference signal and outputs the resulting signal which has non-inverting periods and inverting periods. It should be noted that the amplifier 11 is controlled, based on a non-inverting control signal and an inverting control signal, to output a signal of non-inverting periods and inverting periods. These outputs are averaged in the LPF 13, and the averaged voltage is compared with the reference voltage V0 in the comparator 12. The output of the comparator 12 is then fed-back to the amplifier 11. In this manner, the DC level adjustments of the output signal are performed.

The signal processing circuit of the above type may be used, for example, in a liquid crystal display apparatus. Referring to the block diagram shown in FIG. 12, the drive circuit of a liquid crystal panel comprises: input terminals 51 for video signals, primarily red, blue, green (RGB) color signals in this example; a clamping circuit 52 for maintaining the black (the darkest) level of signals; a gain control/gamma conversion circuit 53 for varying the amplitude of signals and changing the gamma characteristics; an inverting control/signal amplifying circuit 54 for sequentially switching an input signal between non-inverting periods and inverting periods at predetermined intervals and outputting a liquid crystal-driving signal; and a feedback circuit 55 for maintaining the center potential of a liquid crystal-driving signal. An output stage 58 for drive signals includes the inverting control/signal amplifying circuit 54 and the feedback circuit 55. The circuit illustrated in FIG. 11 is applicable to this output stage 58. In FIG. 12, there are also shown a liquid crystal panel 56 and a logic section 57 for forming a clamping pulse, an inverting-control pulse, and a liquid crystal panel-driving pulse.

FIG. 13 is a circuit diagram of the liquid crystal panel 56 shown in FIG. 12. There are shown a pixel portion 61; a horizontal shift register (HSR) 62 used as scanning means in the horizontal direction; a vertical shift register (VSR) 63 serving as scanning means in the vertical direction; input terminals 64-1, 64-2 and 64-3 for signals; a start pulse (HST) 62-1 of the HSR 62; two-phase clock pulses (H1 and H2) 62-2 and 62-3 of the HSR 62; a start pulse (VST) 63-1 of the VSR 63; and two-phase clock pulses (V1 and V2) 63-2 and 63-3 of the VSR 63. The pixel portion 61 includes thin film transistors 6*a*, liquid crystals 6*b*, hold capacitors 6*c*, opposing electrodes 6*d*, video lines 6*e*, vertical signal lines 6*f*, gate (scanning) lines 6*g*, and signal-line selection switches 6*h*.

Signals input from the input terminals 64-1, 64-2 and 64-3 charge the liquid crystals 6*b* and the hold capacitors 6*c* through the video lines 6*e*, the transfer switches 6*h* of the HSR 62, and the vertical signal lines 6*f* in response to the actuation of the thin film transistors 6*a*. To prevent a deterioration in the liquid crystal panel 56 due to burning or other reason, the signal applied to the liquid crystals 6*b* is alternating current having non-inverting periods and inverting periods at regular intervals relative to the voltage of the opposing electrodes 6*d*. The feedback circuit 55 illustrated in FIG. 12 functions to regulate the signal DC level so that the center voltage of the liquid crystal-driving signal having non-inverting and inverting periods can constantly approximate the voltage of the opposing electrodes.

However, the aforedescribed signal processing circuit presents the following problems:

(1) the necessity of changing the time constant of the LPF in response to the speed of input/output signals;

(2) the incorrect adjustment of the DC level of the signal which is significantly changed every time the signal is switched between non-inverting periods and inverting periods; and (3) the requirement for long stabilization time with time constants of several hundreds of horizontal scanning periods (H) (up to 30 milliseconds) caused by, for example, the necessity to average the data obtained in one horizontal scanning period (1H) (typically 62 microseconds) in a liquid crystal drive apparatus.

The above-described problem (2) will now be explained in greater detail with reference to FIG. 14. An input signal has periods to be non-inverted NIVS and periods to be inverted IVS having different characteristics. In this case, the mean value of the non-inverting periods and inverting periods of the output signal deviates from the center value of the output signal. Accordingly, the deviated mean voltage value is unfavorably compared with the reference voltage V0, and the result is fed-back to the amplifier 54, thereby failing to perform the correct adjustments of the DC level.

This problem will be further explained when the above-described signal processing circuit is applied to a liquid crystal display apparatus by way of example. FIG. 15 illustrates an example of the pixel array of the liquid crystal panel 56. Formed on this panel 56 are pixels of red (R), green (G) and blue (B) in a delta form. For allocating the color signals to the respective pixels in accordance with this array, different color pixels (R and B, G and R, B and G) may be connected to the same vertical signal line 6*f* shown in FIG. 13 in the respective horizontal lines. This requires the switching of the signal between the different color pixels to be input into the input terminal 64-1 (64-2 and 64-3) in the respective horizontal scanning periods, such as R (G, B) in the first horizontal scanning period, B (R, G) in the second horizontal scanning period, R (G, B) in the third horizontal scanning period, B (R, G) in the fourth horizontal scanning period, and likewise for each horizontal scanning period.

FIG. 16 is a block diagram of the drive circuit for the liquid crystal panel 56 required for this operation. The same elements corresponding to those shown in FIG. 12 are designated by like reference numerals, and an explanation thereof will thus be omitted. In FIG. 16, there is shown a switch circuit 91 for rearranging the signals in each horizontal scanning period based on the inverting control pulse output from the logic section 57.

FIG. 17 illustrates an input waveform and an output waveform of the output stage 58 of the circuit illustrated in FIG. 16. The input signal is alternately changed by R and B in the first, second, third and fourth horizontal scanning periods (the first H through the fourth H periods), and the resulting output signal is inverted every other horizontal scanning period (1H period). In this case, if the integral of the color signal R differs from that of the color signal B, the center level of the actual output signal deviates from the reference voltage V0 of the circuit shown in FIG. 11 (8*a*≠8*b*). This is one of the reasons for the deterioration of image quality.

SUMMARY OF THE INVENTION

Accordingly, it is an object of the present invention to provide a signal processing circuit which is capable of performing correct adjustments of the DC level and also provide a liquid crystal display apparatus using the above-described signal processing circuit.

In order to achieve the above object, according to one aspect of the present invention, there is provided a signal processing circuit comprising signal processing means for non-inverting and inverting an input signal and outputting a resulting signal whose non-inverting periods and inverting periods each have a period of constant signal value, the signal processing circuit comprising: first sample-and-hold means for performing a sample-and-hold operation on the signal during the period of constant signal value in the non-inverting period; second sample-and-hold means for performing a sample-and-hold operation on the signal during the period of constant signal value in the inverting period; averaging means for averaging the sample-and-hold value of the first sample-and-hold means and the sample-and-hold value of the second sample-and-hold means; and means for comparing the output value of the averaging means with a reference value and, upon comparison, feeding back the resulting value to the signal processing means.

According to another aspect of the present invention, there is provided a signal processing circuit including signal processing means for non-inverting and inverting an input signal and outputting a resulting signal whose non-inverting periods and inverting periods each have a period of constant signal value, the signal processing circuit comprising: first sample-and-hold means for performing a sample-and-hold operation on the signal value during the period of constant signal value in the non-inverting period; second sample-and-hold means for performing a sample-and-hold operation on the constant signal value during the period of constant signal value of the inverting period; and means for comparing the sample-and-hold values of the first and second sample-and-hold means with a reference value and, upon comparison, feeding back the resulting value to the signal processing circuit.

In the aforedescribed signal processing circuits, the signal processing means may not only perform the non-inverting and inverting operation on the input signal, but also amplify the input signal based on a reference value, and this reference value may be equal to the reference value compared with the sample-and-hold values. Alternatively, the signal processing means may not only perform the non-inverting and inverting operation on the input signal, but also amplify the input signal based on a reference value, and this reference value may be different from the reference value compared with the sample-and-hold values.

According to a further aspect of the present invention, there is provided a liquid crystal display apparatus comprising any one of the above-described signal processing circuits, which apply a signal having non-inverting periods and inverting periods whose polarity is inverted at regular intervals to a plurality of liquid crystal pixels disposed in a matrix form.

According to another aspect of the invention, there is provided a method of processing electrical signals which comprises the steps of causing an input signal to be inverted and non-inverted alternately during successive intervals of equal duration, the signal having a period of constant signal value during each of such intervals; performing a sample-and-hold operation on the signal during each period of constant signal value; averaging the sample-and-hold values of successive sample-and-hold operations to produce an average sample-and-hold value; comparing the average sample-and-hold value to a first reference value; and adjusting the value of the input signal based upon such comparison.

According to still another aspect of the invention, there is provided a method of processing electrical signals which comprises the steps of causing an input signal to be inverted and non-inverted alternately during successive intervals of equal duration, such signal having a period of constant signal value during each of such intervals; performing a sample-and-hold operation on the signal during each period of constant signal value; comparing the sample-and-hold values to a first reference value; and adjusting the value of the input signal based upon such comparison.

In yet another aspect, the present invention involves the application of the above described methods to operate a liquid crystal display apparatus.

DETAILED DESCRIPTION OF THE PREFERRED EMBODIMENTS

A detailed description will now be given of preferred embodiments of the present invention.

First Embodiment

Figure 1:
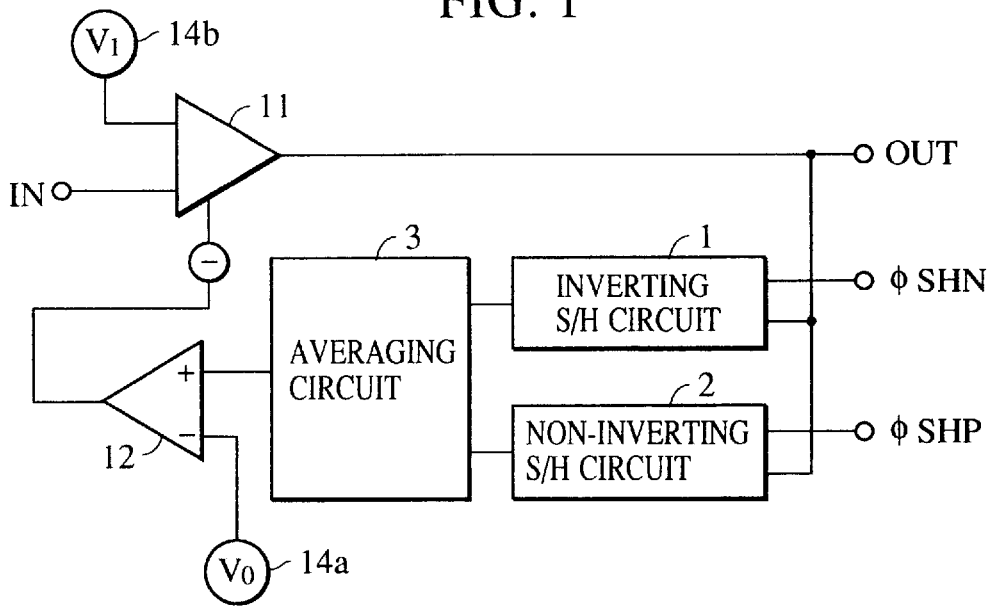
FIG. 1 is a circuit and block diagram of a first embodiment of a signal processing circuit according to the present invention.
Figure 2:
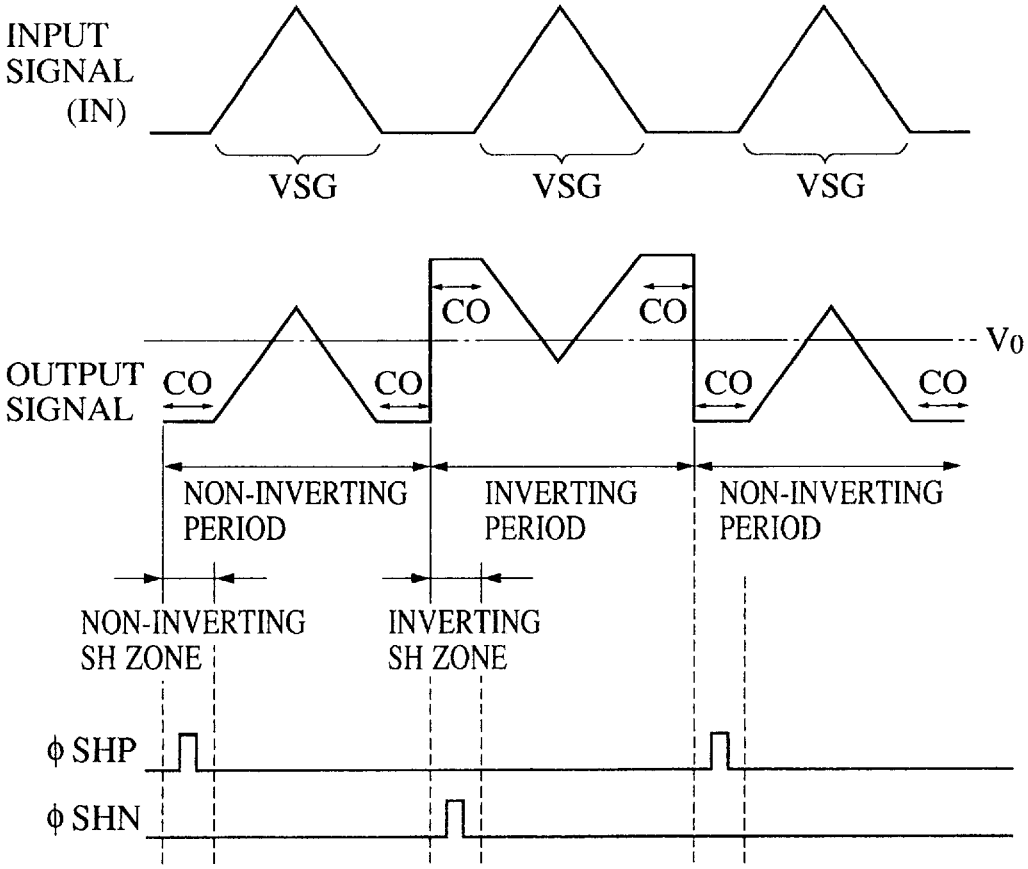
FIG. 2 is a waveform diagram illustrating the operation of the circuit of the same embodiment shown in FIG. 1.

FIG. 1 is a circuit and block diagram illustrating an embodiment of a signal processing circuit according to the present invention. FIG. 2 is a signal waveform diagram illustrating the operation of the circuit shown in FIG. 1. Referring to FIGS. 1 and 2, there are shown an amplifier 11 used as signal processing means and reference voltage sources 14*a* and 14*b* (the respective reference voltages are indicated by V0 and V1 which may be equal to each other). A signal input into the amplifier 11 is non-inverted or inverted, based on the voltage V1, according to a non-inverting control signal or an inverting-control signal, thereby generating the output signal having non-inverting periods and inverting periods.

The output signal has non-inverting periods and inverting periods, as illustrated in FIG. 2, each period having zones CO in which the signal level becomes constant. A sample-and-hold operation is performed on the signal that is output from the amplifier 11 during the above-described zones CO, and more particularly, during the non-inverting sample-and-hold zones (non-inverting SH zones) and the inverting sample-and-hold zones (inverting SH zones) shown in FIG. 2.

The output terminal of the amplifier 11 is connected to an inverting sample-and-hold circuit 1 and to a non-inverting sample-and-hold circuit 2. The sample-and-hold circuits 1 and 2 operate under the control of the pulses ϕSHN and ϕSHP, respectively. During the inverting zones or periods, the signals from the amplifier 11 are subjected to a sample-and-hold operation when a pulse ϕSHN is applied to the circuit 1; and during the non-inverting periods, the signals are subjected to a sample-and-hold operation when a pulse ϕSHP is applied to the circuit 2. The output terminals of the inverting sample-and-hold circuit 1 and the non-inverting sample-and-hold circuit 2 are connected to an averaging circuit 3 in which the hold values of the non-inverting periods and the hold values of the inverting periods are averaged. The output of the averaging circuit 3 is applied to a non-inverting input terminal (+) of a comparator 12. The comparator 12 also has an inverting input terminal (−) which is connected to a reference voltage source 14*a*. Thus, a difference between the output of the averaging circuit 3 and the reference voltage (V0) is output from the comparator 12; and this difference is then fed-back to the amplifier 11 to adjust its gain.

Although in this embodiment the averaged sample-and-hold value is compared with the reference potential, the sample-and-hold values of the respective circuits 1 and 2 may be directly compared with the reference potential without being averaged.

In the present invention, a feedback signal is generated based on the sample-and-hold values (or their mean value) obtained in the constant voltage zones of the respective non-inverting periods and the constant voltage zones of the respective inverting periods. Hence, the DC level adjustments of the output signal can be conducted with high precision without being influenced by a change of (video signal components) of the input signal, which change is caused by the inverting and non-inverting operation. Accordingly, the output signal can be independent of the non-inverting periods and inverting periods which are repeated at regular intervals. It is also possible to maintain the output signal at a stable value without needing to average the entire signal from the amplifier 11, which is conventionally required. Further, the output signal can be stabilized by repeating the sample-and-hold operations several dozens of times, thereby decreasing the stabilization time by one digit or more over the stabilization time required for known circuits.

Second Embodiment

Figure 3:
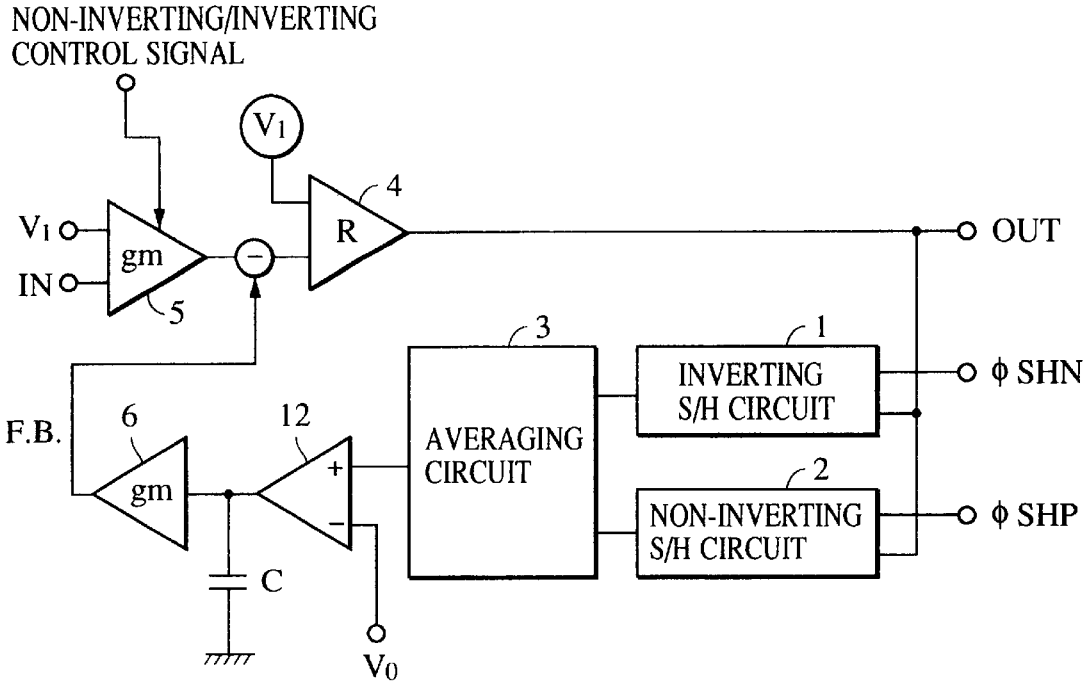
FIG. 3 is a circuit and block diagram of a second embodiment of the present invention.

FIG. 3 is a circuit and block diagram of a second embodiment of a signal processing circuit according to the present invention. In this embodiment, an input signal (IN) is subjected to voltage-to-current conversion in a gm amplifier 5. The gm amplifier 5 receives a non-inverting/inverting control signal which causes it to generate current signals having non-inverting periods and inverting periods. A difference between this current signal and a below-described feedback signal is determined; and this difference is subjected to current-to-voltage conversion in an impedance amplifier 4, and is then output.

Figure 4:
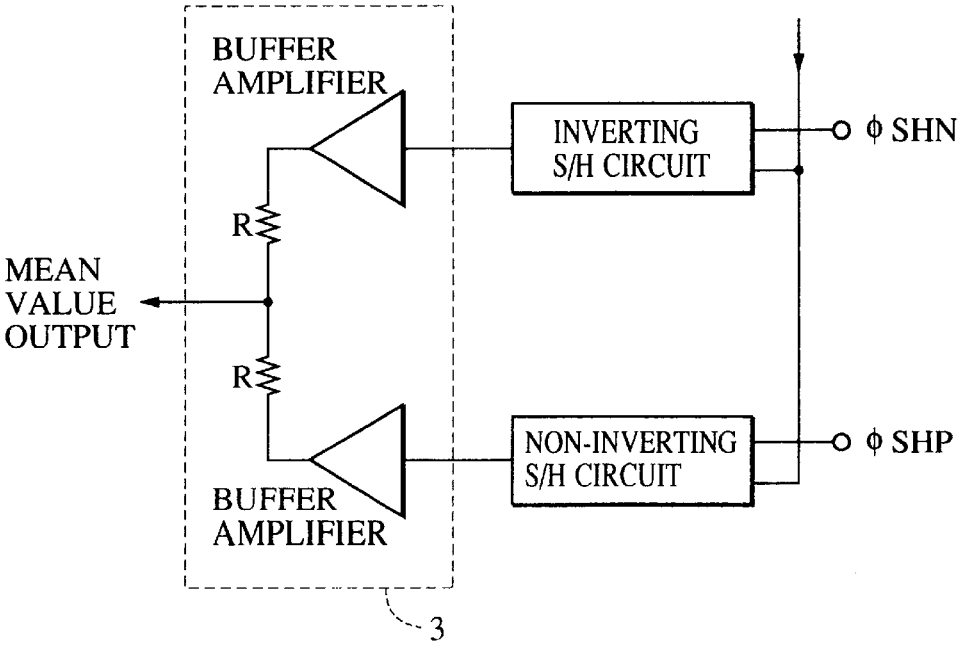
FIG. 4 is a diagram showing the configuration of the averaging circuit of FIG. 3.

The output of the impedance amplifier 4 is input into the inverting sample-and-hold circuit 1 and the non-inverting sample-and-hold circuit 2 which are operable under the control of the pulses ϕSHN and ϕSHP, respectively. The impedance amplifier output is, as shown in FIG. 2, subjected to a sample-and-hold operation while an ϕSHN pulse is applied to the circuit 1 during an inverting period. In contrast, as also shown in FIG. 2, the impedance amplifier output is subjected to a sample-and-hold operation while an ϕSHP pulse is applied to the circuit 2 during a non-inverting period. The output terminals of both the inverting sample-and-hold circuit 1 and the non-inverting sample-and-hold circuit 2 are connected to the averaging circuit 3 in which the sample values of the non-inverting periods and those of the inverting periods are averaged. The averaging circuit 3 may be represented by, for example, the type illustrated in FIG. 4. The output terminal of the averaging circuit 3 is coupled to the non-inverting input terminal (+) of the comparator 12, and the inverting input terminal (−) of the comparator 12 is connected to the reference voltage source V0. The difference between the output of the averaging circuit 3 and the reference voltage (V0) is thus output from the comparator 12 and is stored in a capacitor C. The capacitor C is coupled to a gm amplifier 6 for converting voltage input to current output; and the difference signal is thereby subjected to voltage-to-current conversion. The difference between this current signal from the gm amplifier 6 and the output of the gm amplifier 5 is determined by combining them algebraically and the resulting difference is input into the impedance amplifier 4 for converting current input to voltage output. In this fashion, the DC level adjustments of the output signal are performed.

Third Embodiment

Figure 5:
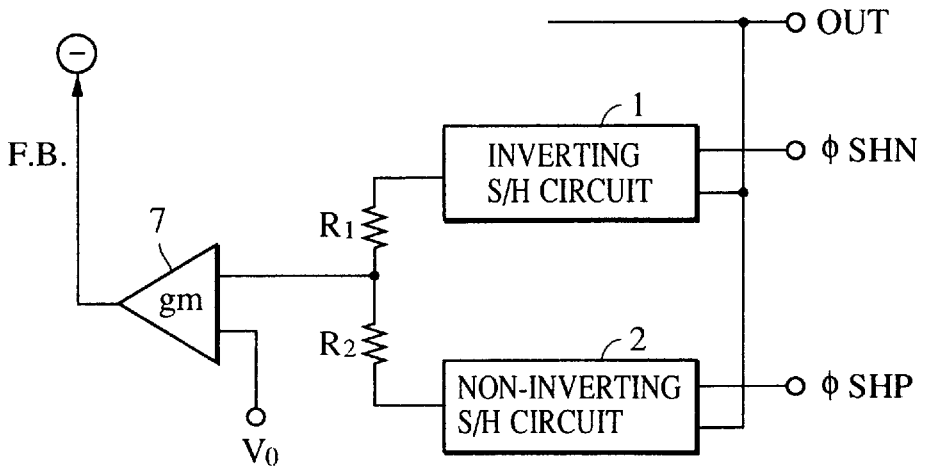
FIG. 5 is a circuit and block diagram of a third embodiment of the present invention.

FIG. 5 is a circuit diagram of a third embodiment of a signal processing circuit according to the present invention. More specifically, FIG. 5 illustrates an example of a circuit arrangement which performs the averaging operation. The output terminals of both the inverting sample-and-hold circuit 1 and the non-inverting sample-and-hold circuit 2 are connected to each other via series connected resistors R1 and R2 which have the same resistance. A node between the two resistors R1 and R2 is connected to a gm amplifier 7 in which the output of the circuits 1 and 2 is subjected to voltage-to-current conversion. The resulting output is then fed-back to the amplifier 4. The timing of the sample-and-hold operation performed by this circuit is similar to the timing shown in FIG. 2.

In this embodiment, the difference between the outputs of the inverting sample-and-hold circuit 1 and the non-inverting sample-and-hold circuit 2 is divided by the resistors R1 and R2, so that one half of the output voltage difference (the averaged voltage) can be input into the gm amplifier 7. A difference between this averaged voltage and the reference voltage V0 undergoes voltage-to-current conversion in the gm amplifier 7 and is then fed-back to the amplifier.

Fourth Embodiment

Figure 6:
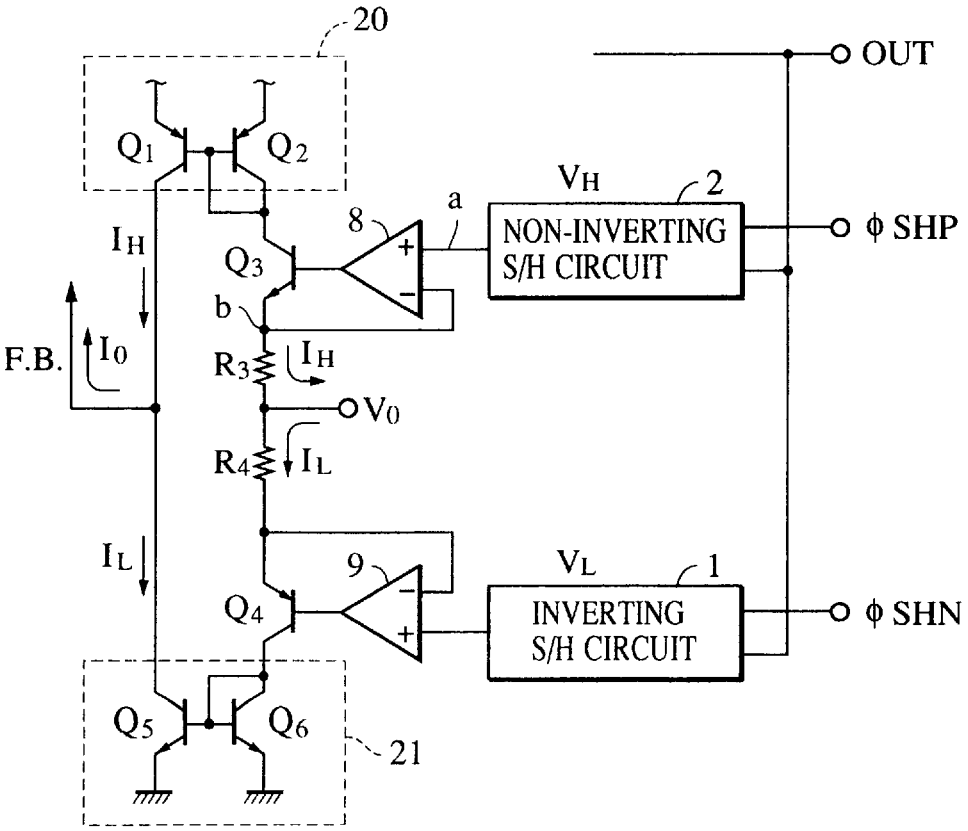
FIG. 6 is a circuit diagram of a fourth embodiment of the present invention.

FIG. 6 is a circuit diagram of a fourth embodiment of a signal processing circuit according to the present invention. More particularly, FIG. 6 illustrates an example of the circuit without performing the averaging operation. The output terminals of the non-inverting sample-and-hold circuit 2 and the inverting sample-and-hold circuit 1 are connected to the non-inverting output terminals (+) of operational amplifiers 8 and 9, respectively.

The output terminals of the operational amplifiers 8 and 9 are connected to a base terminal of an NPN transistor Q3 and to a base terminal of a PNP transistor Q4, respectively. The NPN transistor's Q3 emitter and the PNP transistor's Q4 emitter are connected to each other via series connected resistors R3 and R4 which have the same resistance R. A node between the resistors R3 and R4 is connected to the reference voltage source (V0).

The NPN transistor's Q3 collector and the PNP transistor's Q4 collector are connected, respectively, to a current mirror circuit 20 formed of PNP transistors Q1 and Q2 and to a current mirror circuit 21 formed of NPN transistors Q5 and Q6. The base terminals of the transistors Q1 and Q2 are connected to each other and to the collector of the transistor Q3. Similarly, the base terminals of the transistors Q5 and Q6 are connected to each other and to the collector of the transistor Q4. The output terminals of the current mirror circuits 20 and 21, namely, the collectors of the transistors Q1 and Q5, are connected to each other and then to a common output line. Thus, current flowing in this line is fed-back to the amplifier 4. The timing of the hold-and-sample operation of this circuit is similar to the timing illustrated in FIG. 2.

The operation of the above-described circuit will now be described. When the non-inverting sample-and-hold value (VH) is input into the non-inverting input terminal (+) of the operational amplifier 8 from the non-inverting sample-and-hold circuit 2, the operational amplifier 8 controls the base potential of the NPN transistor Q3 so that the potential a of the non-inverting input terminal (+) of the operational amplifier 8 can become equal to the emitter potential b of the NPN transistor Q3. Namely, the current flowing in the resistor R3 (VH−V0)/R can equal IH.

Similarly, when the inverting sample-and-hold value (VL) is input into the non-inverting input terminal (+) of the operational amplifier 9 from the inverting sample-and-hold circuit 1, the operational amplifier 9 performs an operation similar to that conducted by the amplifier 8. Accordingly, the current flowing in the resistor R4 (V0−VL)/R can become equal to IL. The above-described currents IH and IL are input into the current mirror circuits 20 and 21, respectively, and flow as collector currents of the PNP transistor Q1 and the NPN transistor Q5, respectively. As a consequence, a current indicated by I0=IH−IL flows in the common output line.

As has been discussed above, in order to prevent burning the liquid crystal material for use in a liquid crystal display apparatus, a signal applied to the liquid crystal is an alternating current having non-inverting periods and inverting periods repeated at regular intervals relative to a voltage of the opposing electrodes of the display apparatus. Consequently, the signal processing circuit of the present invention can be suitably used for a liquid crystal display apparatus.

An explanation will now be given of a liquid crystal apparatus using the signal processing circuit of the present invention.

Fifth Embodiment

Figure 7:
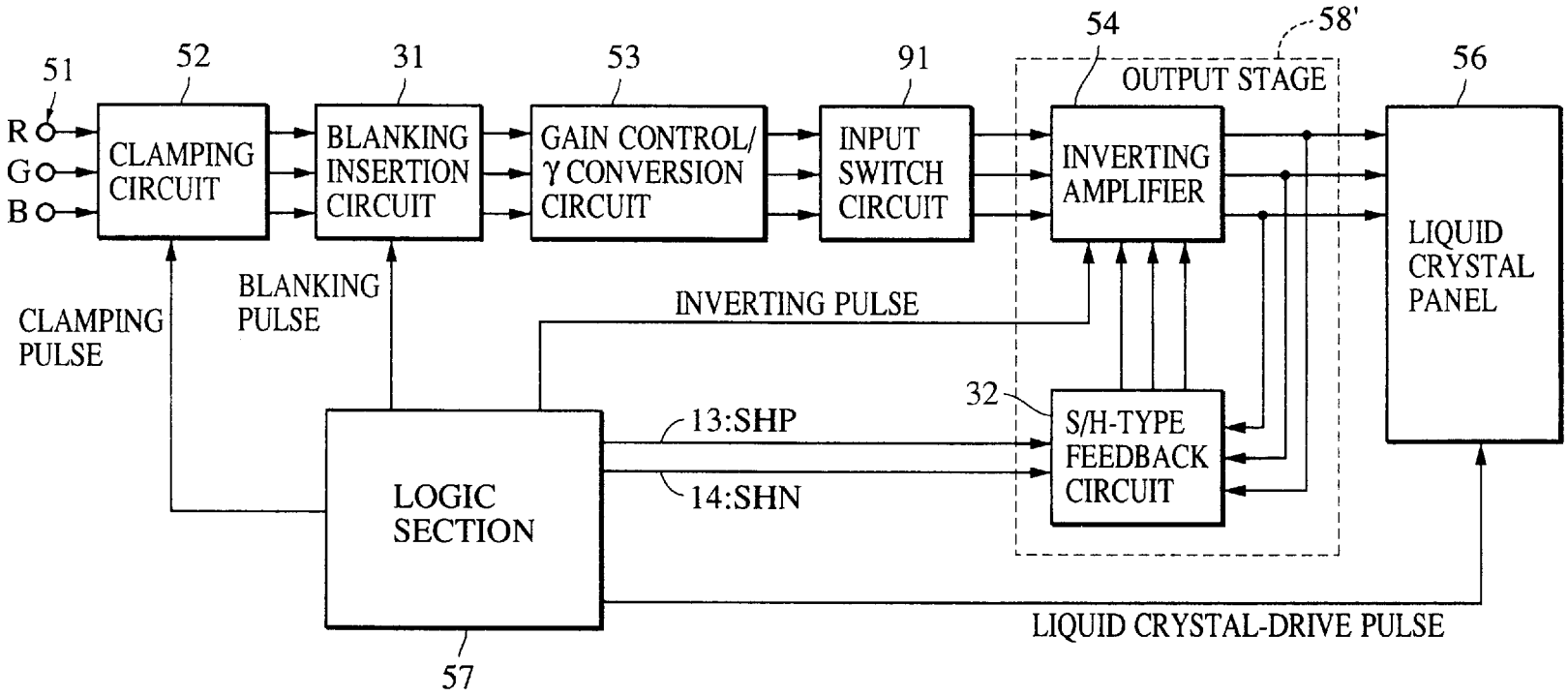
FIG. 7 is a block diagram of a liquid crystal display apparatus according to fifth and sixth embodiments of the present invention.
Figure 16:
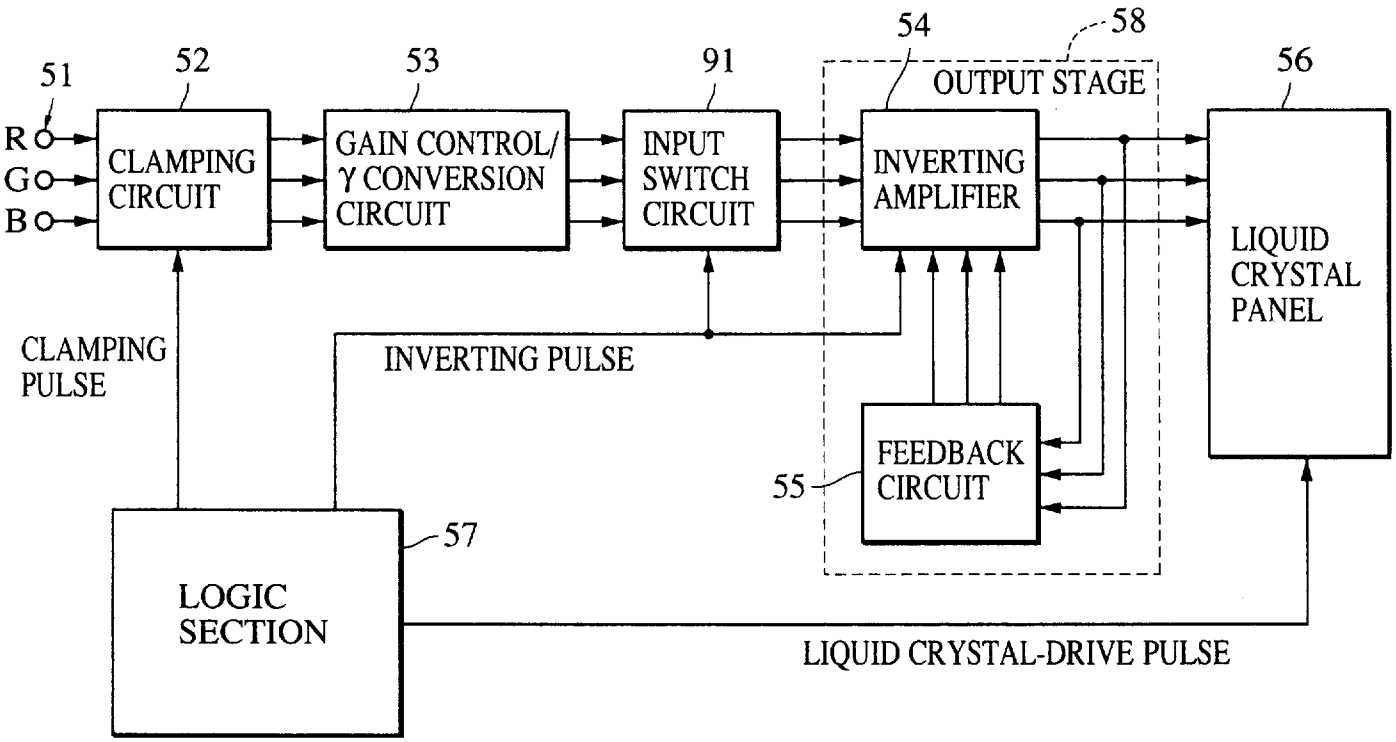
FIG. 16 is a block diagram of another liquid crystal display apparatus.
Figure 17:
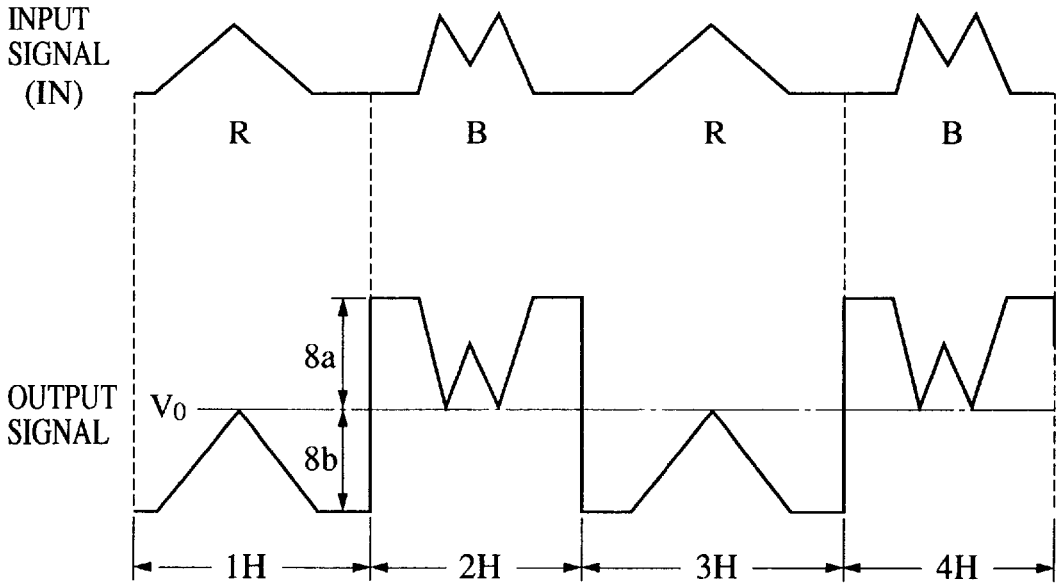
FIG. 17 is a waveform diagram illustrating the operation of the circuit shown in FIG. 16.

FIG. 7 is a block diagram of a liquid crystal-drive circuit of an embodiment of a liquid crystal display apparatus according to the present invention. The same elements corresponding to those shown in FIG. 16 are designated by like reference numerals.

Figure 15:
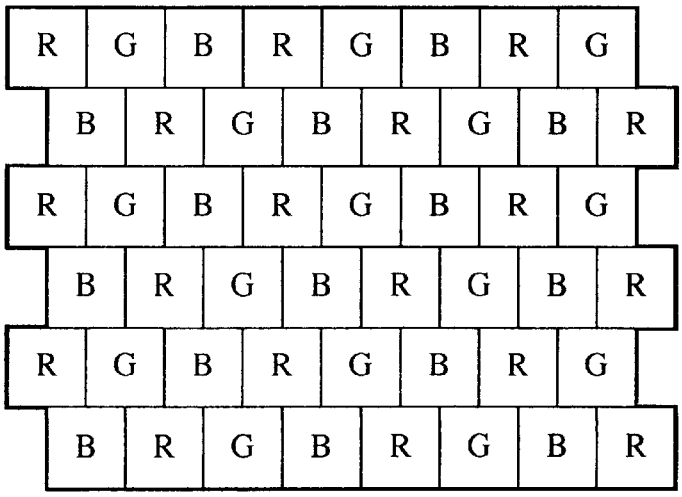
FIG. 15 is a diagram which illustrates an example of the pixel array of the liquid crystal panel.

Referring to FIG. 7, the liquid crystal display apparatus includes: input terminals 51 for inputting video signals, (which in this embodiment, are RGB color signals); a clamping circuit 52 for keeping the signal black level constant; a gain control/gamma conversion circuit 53 for varying the amplitude of signals and changing the gamma characteristics; an inverting control/signal inverting amplifier 54 for switching a signal between non-inverting periods and inverting periods at regular intervals so as to convert it to a liquid crystal-driving signal; and a sample-and-hold-type feedback circuit 32. The inverting control/signal inverting amplifier 54 and the feedback circuit 32 form an output stage 58', which is constructed in a manner similar to the block diagram of FIG. 1. The apparatus also includes a liquid crystal panel 56; a logic section 57 for forming clamping, inverting-control, and liquid crystal panel-driving pulses; a blanking insertion circuit 31 for inserting periods having a constant voltage, which serve as feedback sampling periods, in positions other than the effective signal zones so as to suppress noise caused during the sampling periods and to eliminate the adverse influence of the signal zones other than the effective signal zones; and a signal switching circuit 91. In this embodiment, the liquid crystal panel having the pixel array shown in FIG. 15 is connected to this apparatus. The operation of the output stage 58' will now be explained while referring to the timing charts of FIGS. 1 and 8.

Figures 8, 9:
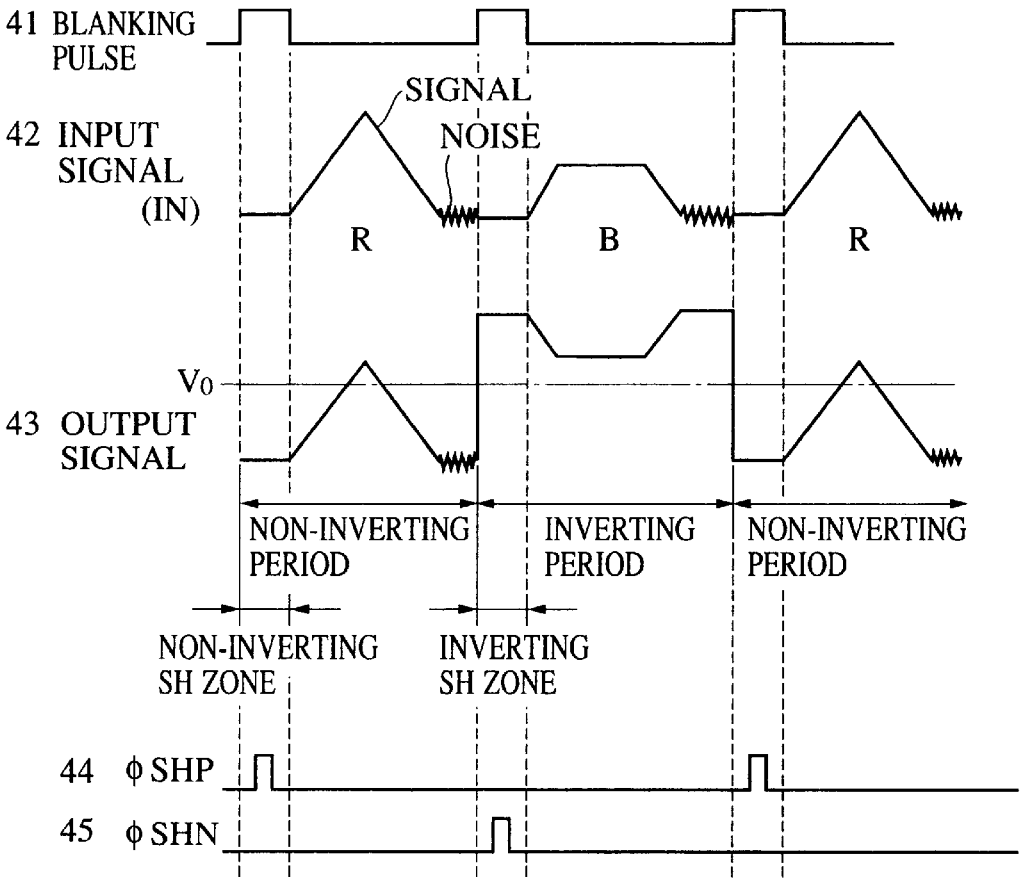
FIG. 8 is a waveform diagram of the operation of the fifth embodiment of the apparatus according to the present invention.
FIG. 9 illustrates the pixel array of a liquid crystal panel according to the sixth embodiment of the present invention.

As has been discussed above while referring to FIG. 1, a signal input into the amplifier 11 is switched, based on the reference voltage V1 of the reference voltage source 14*b*, between non-inverting periods and inverting periods according to a non-inverting control signal and an inverting control signal, respectively. As illustrated in FIG. 8, an input signal 42 input into the amplifier 11 has constant voltage zones in accordance with a blanking pulse 41 generated by the above-described blanking insertion circuit 31. Accordingly, an output signal 43 of the amplifier 11 is formed of non-inverting periods and inverting periods, each period having a zone in which the signal reaches a constant level. The sample-and-hold operation is performed on the signal 43 during the non-inverting sample-and-hold periods (non-inverting SH periods) and the inverting sample-and-hold periods (inverting SH periods), as indicated in FIG. 8. The output terminal of the amplifier 11 is connected to the inverting sample-and-hold circuit 1 and the non-inverting sample-and-hold circuit 2, which are operable under the control of the pulses ϕSHN and ϕSHP, respectively. The inverting periods and the non-inverting periods are subjected to the sample-and-hold operation during the occurrences of the pulses ϕSHN and ϕSHP, respectively. The output terminals of both the inverting sample-and-hold circuit 1 and the non-inverting sample-and-hold circuit 2 are connected to the averaging circuit 3 in which the hold value of the non-inverting periods and that of the inverting periods are averaged. The output terminal of the averaging circuit 3 is coupled to the non-inverting input terminal (+) of the comparator 12. The inverting input terminal (−) of the comparator 12 is connected to the reference voltage source 14*a*. Thus, a difference between the output of the averaging circuit 3 and the reference voltage V0 is output from the comparator 12 and is fed-back to the amplifier 11.

Although in this embodiment the averaged sample-and-hold value is compared with the reference potential, the sample-and-hold values of the respective sample-and-hold circuits may be directly compared with the reference potential without being averaged. It is thus possible to apply any of the signal processing circuits illustrated in FIGS. 3, 5 and 6 to this embodiment. Further, the drive circuit shown in FIG. 7 has constant voltage zones in accordance with the blanking pulse 41 provided by the blanking insertion circuit 31. However, this blanking insertion circuit 31 may be omitted in a simplified drive circuit, in which case, the constant voltage zones of the blanking periods inherent in the video signals may directly undergo the sample-and-hold operation. This modification can offer advantages similar to those achieved by this embodiment.

In this embodiment, a feedback signal is generated based on the sample-and-hold values (or their mean value) obtained in the respective constant voltage zones of the non-inverting periods and in the respective constant voltage zones of the inverting periods. Hence, the DC level adjustments of the output signal can be performed with high precision without being influenced by a change of the input signal between the non-inverting periods and the inverting periods, which change is caused, for example, when different color pixels are connected to the same signal line. This feature can preserve image quality It is also possible to control the output signal to a stable value without needing to average all of the data, which is conventionally required. Thus, the output signal can be independent of the non-inverting periods and inverting periods which are repeated at regular intervals. Further, the output signal can be stabilized by repeating the sample-and-hold operations several dozen of times, thereby decreasing the stabilization time by one digit or more over the stabilization time required for known apparatuses. As a consequence, images can be stabilized in a short period with a small time constant, thereby enabling downsizing of the devices (for example, resistors and capacitors) forming the time constant and also obtaining good response to the variances of images.

Sixth Embodiment

Figure 13:
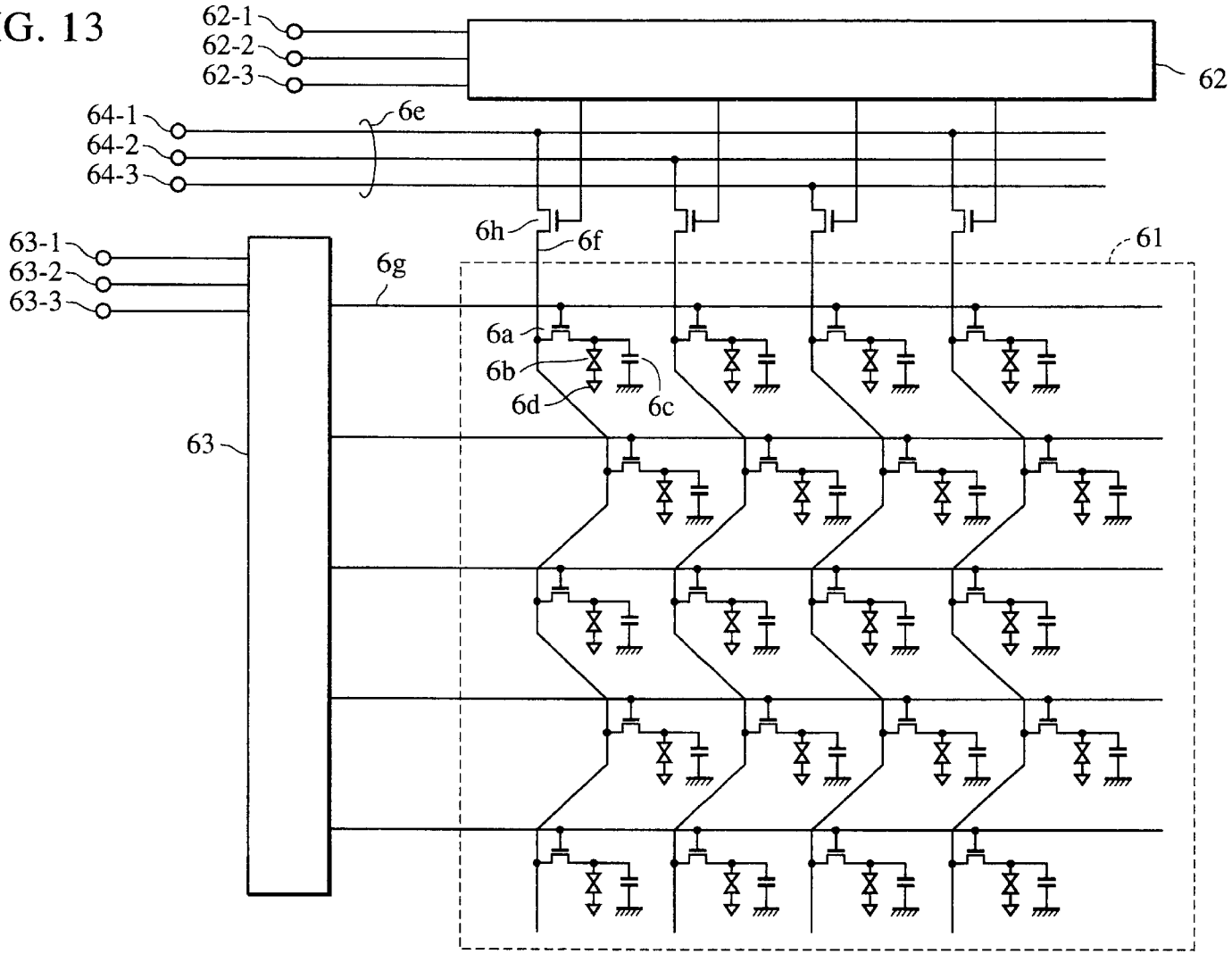
FIG. 13 is a circuit diagram of a liquid crystal panel.
Figure 14:
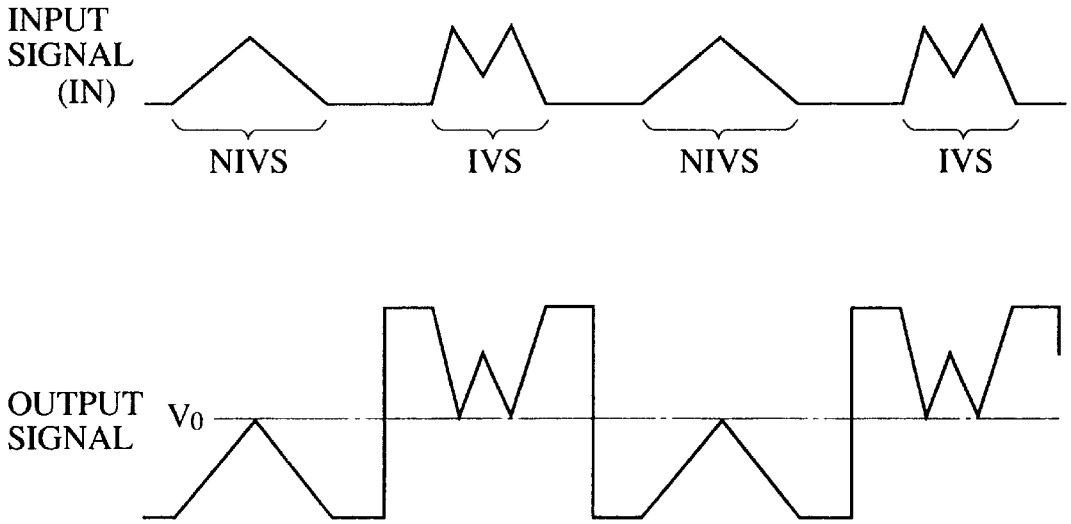
FIG. 14 is a waveform diagram illustrating the operation of the circuit shown in FIG. 13.

FIG. 9 illustrates the pixel array of the liquid crystal panel to be driven according to a sixth embodiment of the present invention. The circuit configuration of the liquid crystal panel can be indicated as shown in FIG. 13, and the drive circuit can be designated by the block diagram of the fourth embodiment of FIG. 7. Moreover, the circuit of the output stage is similar to that illustrated in FIG. 1.

Figure 10:
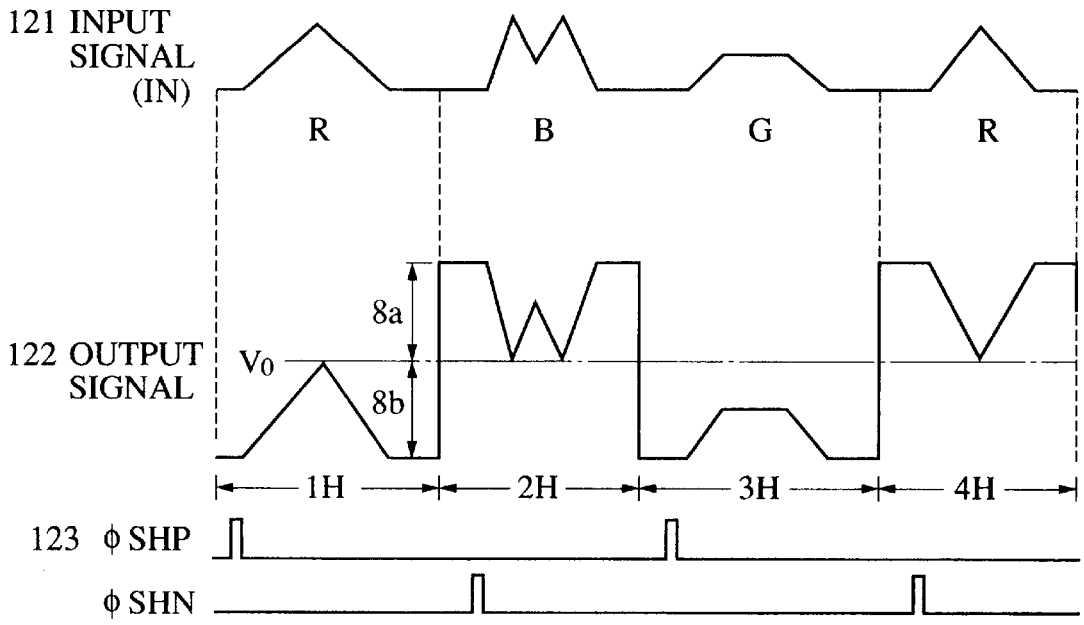
FIG. 10 is a waveform diagram illustrating the operation of the sixth embodiment of the present invention.
Figure 11:
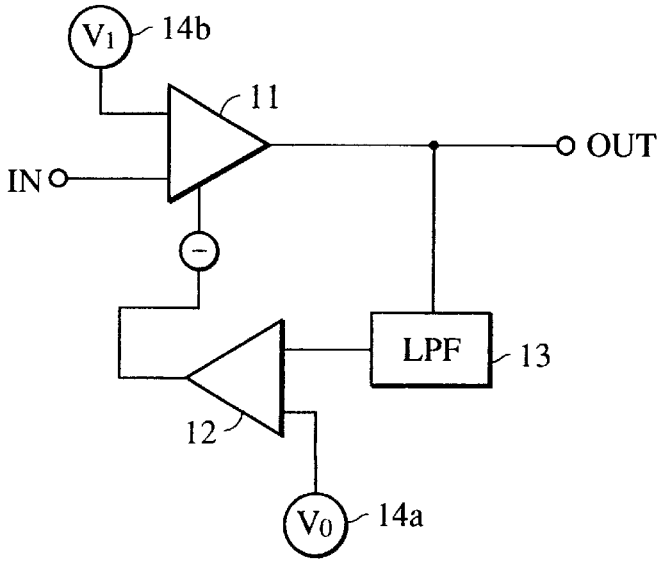
FIG. 11 PRIOR ART
FIG. 11 is a circuit and block diagram of a conventional signal processing circuit.
Figure 12:
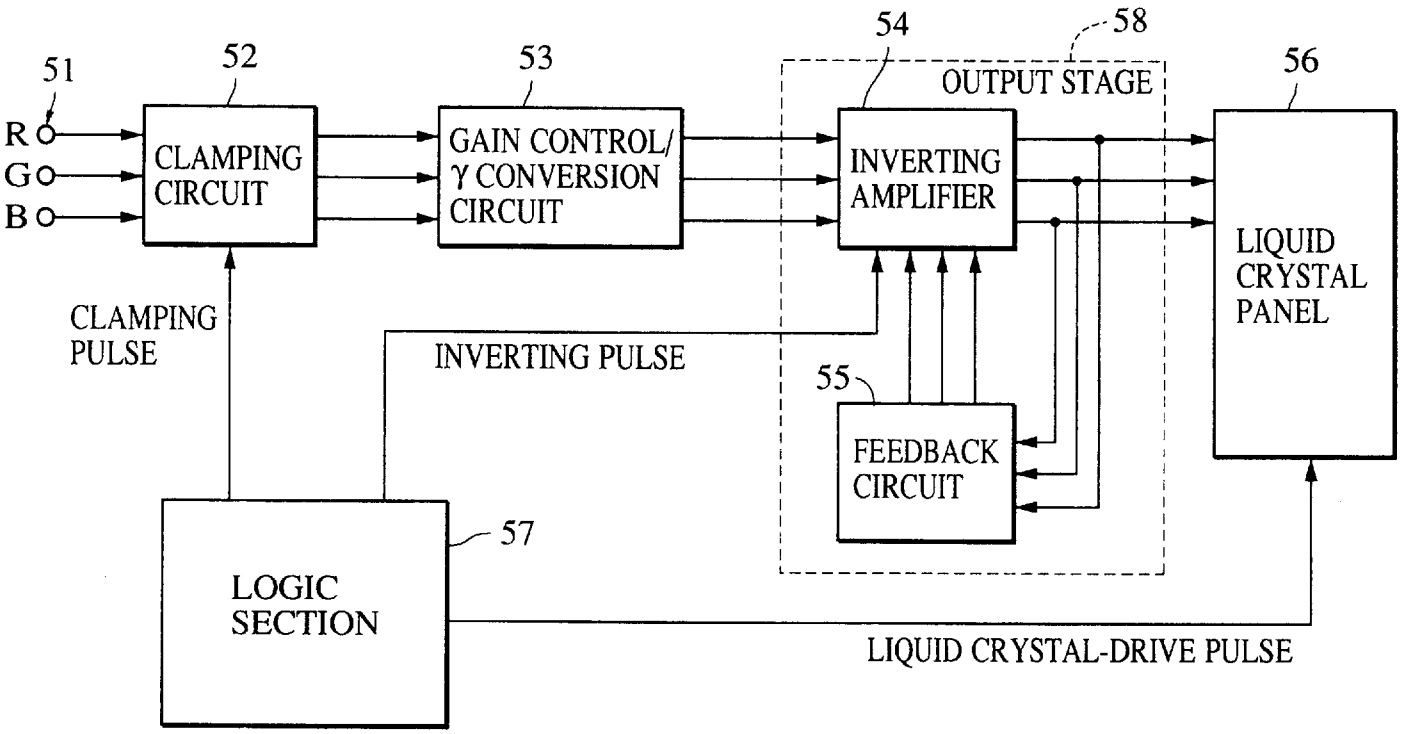
FIG. 12 is a block diagram of a liquid crystal display apparatus.

In this embodiment, the pixel array is arranged in a mosaic form. Accordingly, since the pixels 111 (R), 112 (B) and 113 (G) which are vertically arranged in line with each other are connected to the same vertical signal line 6*f* in FIG. 13, it is necessary to switch the drive signal between R, B and G in every horizontal scanning period. A specific signal waveform of the output stage 58' is shown in FIG. 10. In FIG. 10, there are shown an input signal 121, an output signal 122 and signals 123 for controlling the sample-and-hold operation. Even though the input signal 121 is sequentially switched between the three colors, R, B and G, the zones other than the effective signal zones are subjected to the sample-and-hold operation. As a result, the DC level of the output signal 122 can be correctly controlled to be the reference potential V0 (8*a*=8*b*) according to the operation of this embodiment, which is similar to that of the fifth embodiment.

As will be clearly understood from the foregoing description, the signal processing circuit of the present invention offers the following advantages.

A feedback signal is produced based on the sample-and-hold values (or their mean value) obtained in the respective constant voltage zones of the non-inverting periods and in the respective constant voltage zones of the inverting periods. This enables highly-precise DC level adjustment of the output signal, free from any adverse influence caused by the switching of the input signal between non-inverting and inverting periods.

It is also possible to control the output signal to a stable value without needing to average all of the data, which is conventionally required. Thus, the output signal can be independent of the non-inverting periods and inverting periods which are repeated at regular intervals. Further, the output signal can be stabilized by repeating the sample-and-hold operations several dozens of times, thereby decreasing the stabilization time by one digit or more over the stabilization time required for known circuits.

Further, the liquid crystal drive apparatus of the present invention offers the following advantages.

A feedback signal, which is derived from the output signal to be input into the liquid crystal panel 56 from the drive circuits, is generated based on the sample-and-hold values (or their mean value) obtained in the respective constant voltage zones of the non-inverting and inverting periods. It is therefore possible to perform highly-precise DC level adjustments of the output signal without being affected by the switching of the input signal between non-inverting and inverting periods, which switching occurs, for example, when different color pixels are connected to the same signal line. This feature can thus preserve image quality.

Moreover, the output signal can be controlled to a stable value without need to average all of the data, which is conventionally required. Hence, the output signal can be independent of the non-inverting periods and the inverting periods, which are repeated at regular intervals. Additionally, the output signal can be stabilized by repeating the sample-and-hold operations several dozens of times, thereby decreasing the stabilization time by one digit or more over the stabilization time required for known apparatuses. As a consequence, images can be stabilized in a short period with a small time constant, thereby enabling the downsizing of devices (for example, resistors and capacitors) forming the time constant and also obtaining good response to the variances of images.

What is claimed is:

1. A signal processing circuit comprising signal processing means for non-inverting and inverting an input signal and outputting a resulting signal whose non-inverting periods and inverting periods each have a constant signal value period, said signal processing circuit comprising:

first sample-and-hold means for performing a sample-and-hold operation on the constant signal value which occurs during constant signal value period of said non-inverting period;

second sample-and-hold means for performing a sample-and-hold operation on the constant signal value which occurs during the constant signal value period of said inverting period;

averaging means for averaging the sample-and-hold value of said first sample-and-hold means and the sample-and-hold value of said second sample-and-hold means; and means for comparing the output value of said averaging means with a reference value and, upon comparison, feeding back the resulting value to said signal processing means.

2. A signal processing circuit comprising signal processing means for non-inverting and inverting an input signal and outputting a resulting signal whose non-inverting periods and inverting periods each have a constant signal value period in which the signal value becomes constant, said signal processing circuit comprising:

first sample-and-hold means for performing a sample-and-hold operation on the constant signal value which occurs during the constant signal value period of said non-inverting period;

second sample-and-hold means for performing a sample-and-hold operation on the constant signal value which occurs during the constant signal value period of said inverting period; and means for comparing the sample-and-hold values of said first and second sample-and-hold means with a reference value and, upon comparison, feeding back the resulting value to said signal processing circuit.

3. A signal processing circuit according to one of claims 1 and 2, wherein said signal processing means not only performs the non-inverting and inverting operation on the input signal, but also amplifies the input signal based on a reference value, said reference value being equal to the reference value compared with the sample-and-hold values.

4. A signal processing circuit according to one of claims 1 and 2, wherein said signal processing means not only performs the non-inverting and inverting operation on the input signal, but also amplifies the input signal based on a reference value, said reference value being different from the reference value compared with the sample-and-hold values.

5. A liquid crystal display apparatus comprising a signal processing circuit for applying a signal having non-inverting periods and inverting periods, whose polarity is inverted at regular intervals, to a plurality of liquid crystal pixels disposed in a matrix form, said signal processing circuit including signal processing means for non-inverting and inverting an input signal and outputting a resulting signal whose non-inverting periods and inverting periods each have a constant signal value period in which the signal value becomes constant, first sample-and-hold means for performing a sample-and-hold operation on the constant signal value which occurs during the constant signal value period of said non-inverting period, second sample-and-hold means for performing a sample-and-hold operation on the constant signal value which occurs during the constant signal value period of said inverting period, averaging means for averaging the sample-and-hold value of said first sample-and-hold means and the sample-and-hold value of said second sample-and-hold means, and means for comparing the output value of said averaging means with a reference value and, upon comparison, feeding back the resulting value to said signal processing means.

6. A liquid crystal display apparatus comprising a signal processing circuit for applying a signal having non-inverting periods and inverting periods whose polarity is inverted at regular intervals to a plurality of liquid crystal pixels disposed in a matrix form, said signal processing circuit including signal processing means for non-inverting and inverting an input signal and outputting a resulting signal whose non-inverting periods and inverting periods each have a constant signal value period in which the signal value becomes constant, first sample-and-hold means for performing a sample-and-hold operation on the constant signal value which occurs during the constant signal value period of said non-inverting period, second sample-and-hold means for performing a sample-and-hold operation on the constant signal value which occurs during the constant signal value period of said inverting period, and means for comparing the sample-and-hold values of said first and second sample-and-hold means with a reference value and, upon comparison, feeding back the resulting value to said signal processing circuit.

7. A liquid crystal display apparatus according to one of claims 5 and 6, wherein said signal processing means not only performs the non-inverting and inverting operation on the input signal, but also amplifies the input signal based on a reference value, said reference value being equal to the reference value compared with the sample-and-hold values.

8. A liquid crystal display apparatus according to one of claims 5 and 6, wherein said signal processing means not only performs the non-inverting and inverting operation on the input signal, but also amplifies the input signal based on a reference value, said reference value being different from the reference value compared with the sample-and-hold values.

9. A signal processing circuit according to claim 1 or claim 2, wherein said values are voltage values.

10. A signal processing circuit according to claim 1 or claim 2, wherein said values are current values.

11. A signal processing circuit according to claim 1 or claim 2, wherein said means for feeding back the resulting value to said signal processing means changes the gain of said signal processing means.

12. A signal processing circuit according to claim 1 or claim 2, wherein said means for feeding back the resulting value to said signal processing means algebraically combines the resulting value to the output of said signal processing means.

13. A signal processing circuit according to claim 1, wherein said averaging means comprises impedance means connected between the outputs of said sample-and-hold circuits and wherein the output of said averaging means is taken from along said impedance means.

14. A method of processing electrical signals, said method comprising the steps of:

causing an input signal to be inverted and non-inverted alternately during successive intervals of equal duration, said signal having a period of constant signal value during each of said intervals;

performing a sample-and-hold operation on said signal during each period of constant signal value;

averaging the sample-and-hold values of successive sample-and-hold operations to produce an average sample-and-hold value;

comparing said average sample-and-hold value to a first reference value; and adjusting the value of the input signal based upon such comparison.

15. A method of processing electrical signals, said method comprising the steps of:

causing an input signal to be inverted and non-inverted alternately during successive intervals of equal duration, said signal having a period of constant signal value during each of said intervals;

performing a sample-and-hold operation on said signal during each period of constant signal value;

comparing said sample-and-hold value to a first reference value; and adjusting the value of the input signal based upon such comparison.

16. A method of signal processing according to one of claims 14 and 15, wherein during the step of causing an input signal to be inverted and non-inverted, said input signal is amplified based on a second reference value which is equal to said first reference value.

17. A method of signal processing according to one of claims 14 and 15, wherein during the step of causing an input signal to be inverted and non-inverted, said input signal is amplified based on a second reference value which is different from said first reference value.

18. A method of operating a liquid crystal display apparatus, said method comprising the steps of:

applying an input signal which has been inverted and non-inverted alternately during successive intervals of equal duration, said input signal having a fixed amplitude during a portion of each of said intervals, to a plurality of liquid crystal pixels which are disposed in a matrix formation;

performing a sample-and-hold operation on said signal during each fixed amplitude portion;

averaging the sample-and-hold values of successive sample-and-hold operations to produce an average sample-and-hold value;

comparing the average sample-and-hold value to a first reference value; and adjusting the value of the input signal based upon such comparison.

19. A method of operating a liquid crystal display apparatus, said method comprising the steps of:

applying an input signal, which has been inverted and non-inverted alternately during successive intervals of equal duration, said input signal having a fixed amplitude during a portion of each of said intervals, to a plurality of liquid crystal pixels which are disposed in a matrix formation;

performing a sample-and-hold operation on said signal during each fixed amplitude portion to produce sample-and-hold values;

comparing said average sample-and-hold value to a first reference value; and adjusting the value of the input signal based upon such comparison.

20. A method of operating a liquid crystal display apparatus according to claim 18 or 19, wherein during the step of causing an input signal to be inverted and non-inverted, said input signal is amplified based on a second reference value which is equal to said first reference value.

21. A method of operating a liquid crystal display apparatus according to claim 18 or 19, wherein during the step of causing an input signal to be inverted and non-inverted, said input signal is amplified based on a second reference value which is different from said first reference value.

22. A method according to claim 14 or claim 15, wherein said values are voltage values.

23. A method according to claim 14 or claim 15, wherein said values are current values.

24. A method according to claim 14 or claim 15, wherein the step of adjusting the value of the input signal based upon such comparison is carried out by changing the gain of said signal processing means.

25. A method according to claim 14 or claim 15, wherein the step of adjusting the value of the input signal based upon such comparison is carried out by algebraically combining the resulting value to the output of said signal processing means.

26. A signal processing circuit according to claim 14, wherein the step of averaging the sample-and-hold values of successive sample-and-hold operations to produce an average sample-and-hold value comprises taking an output from along impedance means connected between the outputs of sample-and-hold circuits.

* * * * *

UNITED STATES PATENT AND TRADEMARK OFFICE

CERTIFICATE OF CORRECTION

PATENT NO. : 5,889,503

DATED : March 30, 1999

INVENTOR(S): SHIN KIKUCHI ET AL.

It is certified that error appears in the above-identified patent and that said Letters Patent is hereby corrected as shown below:

ON COVER PAGE AT [56] U.S. PATENT DOCUMENTS.

"Kobayaski et al." should read --Kobayashi et al.--.

COLUMN 9

Line 44, "dozen" should read --dozens--.

COLUMN 14

Line 34, "signal processing circuit" should read --method--.

Signed and Sealed this

Fourth Day of January, 2000

*Attest:*

*Attesting Officer*

*Acting Commissioner of Patents and Trademarks*